US009220930B2

(12) United States Patent
Robey et al.

(10) Patent No.: US 9,220,930 B2
(45) Date of Patent: Dec. 29, 2015

(54) AMPLIFIER MOUNT FOR A CLOSED-CIRCUIT BREATHING APPARATUS MASK

(71) Applicant: Draeger Safety, Inc., Pittsburgh, PA (US)

(72) Inventors: Eric J. Robey, Colliers, WV (US); Robert H. Sell, Oakdale, PA (US)

(73) Assignee: Draeger Safety, Inc., Pittsburgh, PA (US)

( * ) Notice: Subject to any disclaimer, the term of this patent is extended or adjusted under 35 U.S.C. 154(b) by 384 days.

(21) Appl. No.: 13/836,083

(22) Filed: Mar. 15, 2013

(65) Prior Publication Data

US 2014/0261404 A1 Sep. 18, 2014

(51) Int. Cl.
*A62B 18/02* (2006.01)
*A62B 18/08* (2006.01)

(52) U.S. Cl.
CPC ..... *A62B 18/082* (2013.01); *A62B 18/02* (2013.01); *A62B 18/08* (2013.01)

(58) Field of Classification Search
CPC ..... A61M 16/00; A61M 16/06; A62B 7/00; A62B 7/08; A62B 7/10; A62B 7/12; A62B 7/14; A62B 9/00; A62B 9/04; A62B 18/00; A62B 18/02; A62B 18/04; A62B 18/045; A62B 18/08; A62B 18/082; A42B 3/26
USPC ..... 128/201.16
See application file for complete search history.

(56) References Cited

U.S. PATENT DOCUMENTS

| | | | | | |
|---|---|---|---|---|---|
| 1,978,994 | A | * | 10/1934 | Fortunato | 128/201.16 |
| 2,902,033 | A | * | 9/1959 | Galleher, Jr. | 128/201.16 |
| 3,890,647 | A | * | 6/1975 | Warncke | 2/435 |
| 4,027,354 | A | * | 6/1977 | Burpee | 15/250.3 |
| 4,215,437 | A | * | 8/1980 | Kao | 2/424 |
| 2008/0184464 | A1 | * | 8/2008 | Chen | 2/422 |

FOREIGN PATENT DOCUMENTS

| | | | | |
|---|---|---|---|---|
| GB | 986834 | A | * | 3/1965 |
| GB | 2082896 | A | * | 3/1982 |

* cited by examiner

*Primary Examiner* — Lynne Anderson
*Assistant Examiner* — Kathryn E Ditmer
(74) *Attorney, Agent, or Firm* — Jones Day

(57) ABSTRACT

A component in a mask in a closed-circuit breathing apparatus includes a lever that actuates a wiper in the mask as well as mount for a communication amplifier. The combined amplifier mount and actuating lever can reduce the profile of the means of actuating the wiper and provide an alternative to using chemical means for preventing the deposition of condensation on the inside of a viewing lens of the mask.

16 Claims, 8 Drawing Sheets

AMPLIFIER MOUNT FOR A CLOSED-CIRCUIT BREATHING APPARATUS MASK

TECHNICAL FIELD

The subject matter described herein relates generally to the field of breathing apparatus masks with a voice amplifier attached to each mask, and more particularly to closed-circuit breathing apparatus masks that are worn for extended periods of time.

BACKGROUND

Some tasks require self-contained breathing systems in which air is recycled. Such systems include masks through which a wearer observes his or her surroundings, as well as communicates with those in the vicinity, such as co-workers. Closed-circuit breathing apparatus masks can be worn for long periods of time, during which moisture can build up in the recycled air due to perspiration and the moisture present exhaled air and result in condensation on the inside of such masks.

Conventional methods of mitigating condensation that collects on the inside of a mask used in a closed-circuit breathing apparatus include the application of an anti-fogging compound. Using this type of compound can be unwieldy in a system that has to be cleaned and sterilized after each use. A means that allows for removing the condensation on the inside of such masks is needed that is convenient, unobtrusive, and if possible, light weight and robust.

Desirable is a means for mounting a sound amplifier on a mask used in a closed-circuit breathing apparatus that is robust, well-placed, and does not add extra weight to the mask. Ideal would be a combination of a means for removing condensation on the inside of a mask with such a means for mounting a sound amplifier in a closed-circuit breathing apparatus that makes the mask easier to use and wear by providing the needed functionality while adding a minimum amount of weight.

SUMMARY

In one aspect, an apparatus includes a mounting plate with a first side configured to interface with a sound receiver and a lever attached adjacent to a second side of the mounting plate such that it is configured to rotate and actuate a wiper located on a first side of a lens of a breathing mask. The first side of the lens is located closest to a wearer of the breathing mask and the wiper is configured to remove condensation from the inside of the lens.

The apparatus can include a sound transmitting opening in the mounting plate. The sound transmitting opening can be configured to allow sound made by the wearer of the mask to reach the sound receiver.

The apparatus can include a lower portion of the mounting plate on the second side of the mounting plate and a forward portion of the mounting plate that contacts the sound receiver. The lower portion of the mounting plate can be configured to limit the travel of the lever. The forward portion of the mounting plate can be configured to allow attachment components of the sound receiver to reversibly connect to the mounting plate. The attachment components of the sound receiver can include spring loaded clips that are biased towards a configuration that latches the sound receiver to the forward portion of the mounting plate.

The sound receiver can include a microphone, a speaker, a transmitter, or a transceiver. The sound receiver can be configured to transmit sound made by the wearer to a receiving device. The receiving device can include a sound recording component.

In another aspect, a system includes a breathing mask that, in turn, includes a lens with a first side that is closer to a wearer of the mask, a wiper positioned in contact with the first side of the lens, and a sounding plate located towards a bottom portion of the breathing mask, adjacent to the lens, configured to transmit sound from within the mask in a direction outside the mask. The breathing mask also includes a mounting plate with a first side oriented away from the wearer and a second side oriented towards the wearer. The mounting plate includes a sound transmitting opening located in the bottom portion of the breathing mask, configured to overlap the sounding plate and the mounting plate includes a lever on the second side of the mounting plate to actuate the wiper. The breathing mask also includes a sound receiver configured to attach to first side of the mounting plate. The system also includes a hose connector reversibly attached to a hose connection opening in the mask such that the hose connection opening located in the bottom portion of the mask, adjacent to the mounting plate. The system also includes a hose operably connected to the hose connector and another portion of the system.

The system can be a closed-circuit breathing apparatus.

The sound receiver can receive sound generated by the wearer with the sound travelling through a diaphragm and the sound transmitting opening.

The sound transmitting opening can be configured to allow sound made by the wearer of the mask to reach the sound receiver.

The mounting plate can include a lower portion the second side of the mounting plate and a forward portion of the mounting plate that contacts the sound receiver. The lower portion of the mounting plate can be configured to limit the travel of the lever. The forward portion of the mounting plate can be configured to allow attachment components of the sound receiver to reversibly connect to the mounting plate. The attachment components of the sound receiver can include spring loaded clips that are biased towards a configuration that latches the sound receiver to the forward portion of the mounting plate.

The details of one or more variations of the subject matter described herein are set forth in the accompanying drawings and the description below. Other features and advantages of the subject matter described herein will be apparent from the description and drawings, and from the claims.

DESCRIPTION OF DRAWINGS

Like reference symbols in the various drawings indicate like elements.

DETAILED DESCRIPTION

Disclosed herein is a connective component of a mask that is part of a closed-circuit breathing apparatus. The connective component allows for the attachment of a sound amplifier to the front of the mask, as well as enabling the wearer of the mask to actuate a wiper within mask, behind a lens, to ensure that moisture build-up within the mask does not occlude the wearer's view, especially during periods of extended wear. This connective component thus allows for effective communication via the sound amplifier and clear vision for the wearer.

Figure 1:
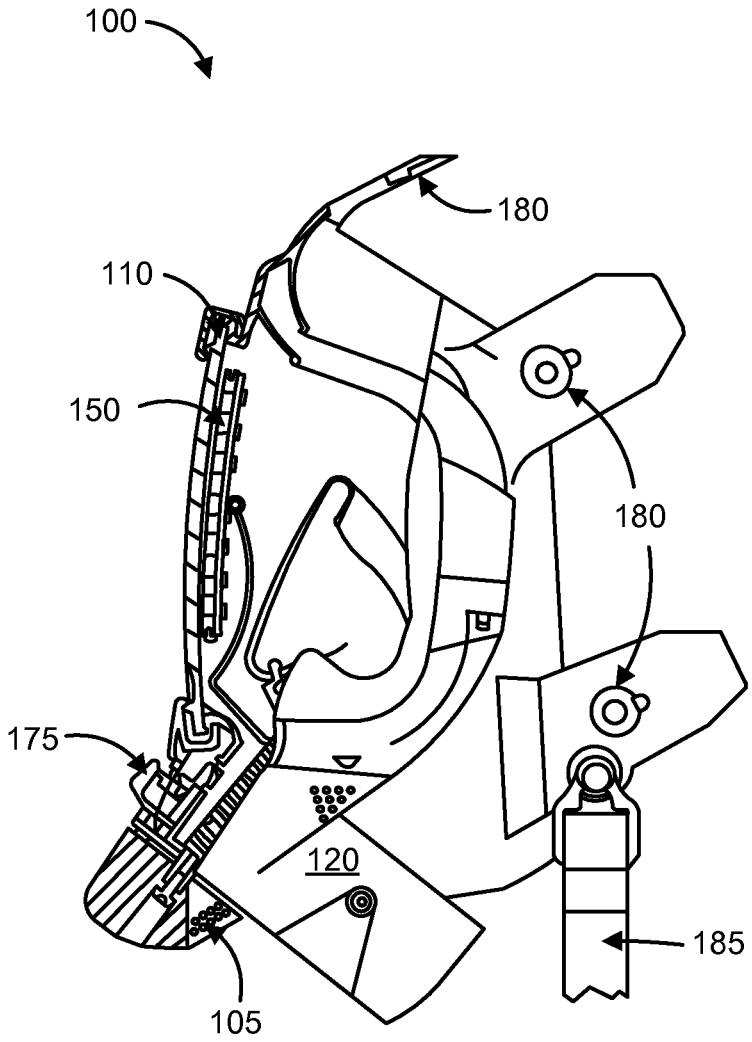
FIG. 1 is a schematic showing an implementation of a mask for a closed-circuit breathing apparatus.

FIG. 1 is a schematic showing an implementation of a mask for a closed-circuit breathing apparatus 100. The mask shown in FIG. 1 has a knob 105 that is attached to the lower front portion, or cowling, 120 of the mask. Above the cowling 120 is a lens 110, and behind the lens 110 is a wiper 150. The mask 100 has tabs 180 for attaching the mask 100 to the wearer's head. Also above the knob 105 is a release button 175 which enables a user, such as the wearer, to remove a hose connector. The mask 100 can also have a strap 185 which allows mask 100 to be carried around the user's neck before donning.

The mask shown in FIG. 1 is representative of masks in use in current closed-circuit breathing apparatus systems. A user, such as the person who will wear the mask 100, can attach a hose connector to mask, and in turn, connect a hose that leads to the rest of the closed-circuit breathing apparatus. The user can then place the mask 100 with the lens 110 in front of his or her eyes. The tabs 180 are attachment points for straps which hold the mask 100 in place on the wearer's head, and the wearer can tighten or loosen the straps as needed. If the mask 100 of the closed-circuit breathing apparatus is worn for an extended period of time, such as more than an hour, condensation can form on the inside of the lens 110.

The condensation can be removed with the wiper 150. The wearer, or another user, can actuate the wiper 150, moving it from one side of the lens 110 to the other, by turning the knob 105. The knob 105 can be turned as often as needed to maintain a clear view through the lens 110 or as often as the wearer is able while performing his or her other tasks.

When the wearer needs to communicate with others, he or she can speak or make sounds that are transmitted through a sound diaphragm. The sounds that travel through the sound diaphragm can be picked up by a sound amplifier (not shown) and transmitted to the area surrounding the mask wearer. In this manner, the person wearing the mask 100 can share information, such as his or her condition, the location of important items, and the like. When the wearer has completed his or her tasks, he or she can disconnect a hose connector from the mask 100 by depressing a release button 175.

Figure 2:
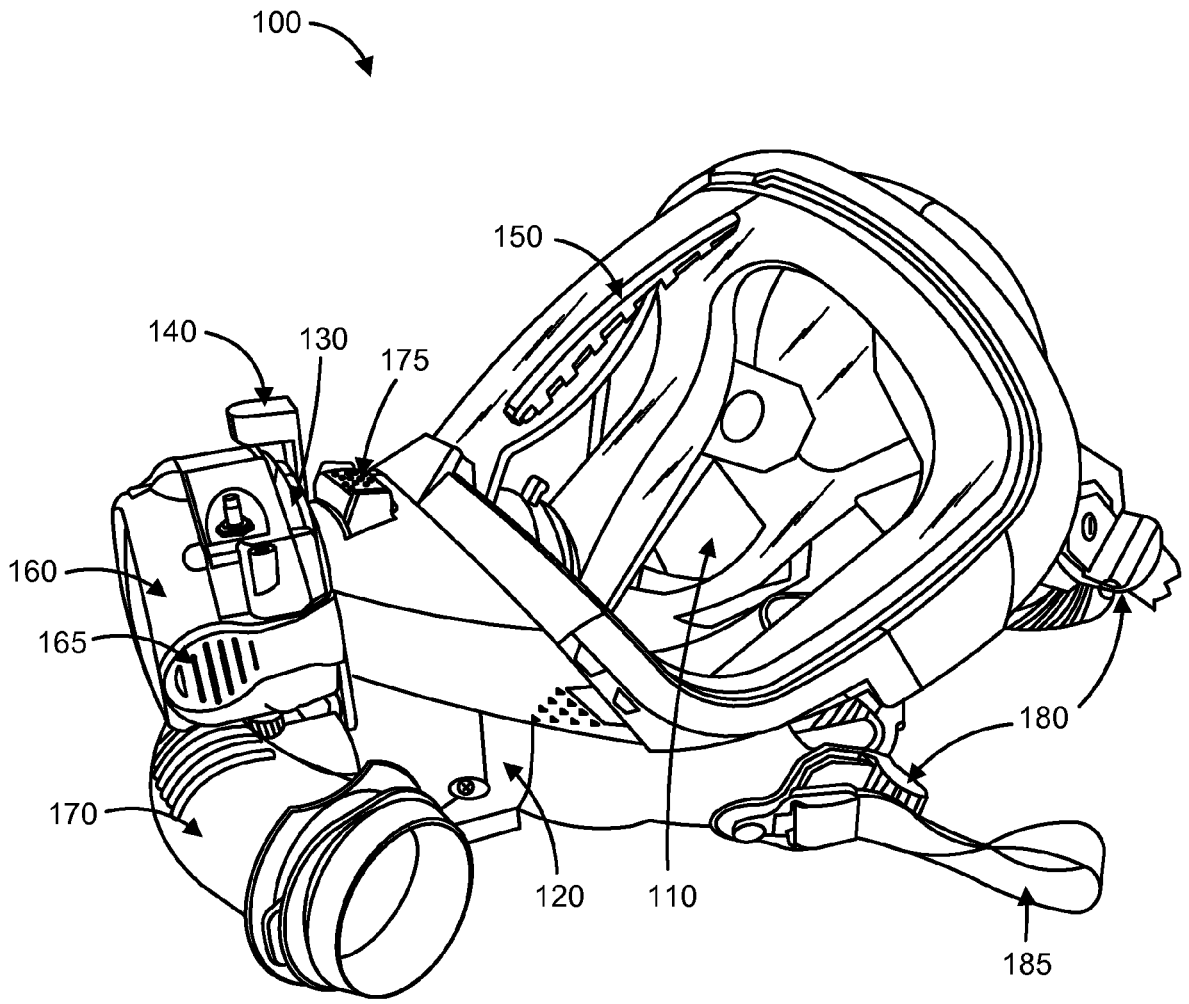
FIG. 2 illustrates another implementation of a mask for a closed-circuit breathing apparatus that includes a component for mounting a sound amplifier to the mask as well as a lever for actuating a lens wiper within the mask.

FIG. 2 illustrates another implementation of a mask 100 for a closed-circuit breathing apparatus that includes a component 130 for mounting a sound amplifier 160 to the mask 100 as well as a lever 140 for actuating a lens wiper 150 within the mask 100. The mask 100 has a lens 110; a wiper 150 behind the lens 110; attachment tabs 180; a lower portion, or cowling, 120; an amplifier mount, or attachment component, 130; and amplifier 160; a hose connection piece 170; and a hose release button 175.

The amplifier mount 130 includes the lever 140 for actuating the wiper 150. The amplifier 160 attaches to the amplifier mount 130 via spring loaded clips 165 located on either side of the amplifier 160. The clips 165 are biased by springs into a position that holds the amplifier 160 onto the amplifier mount 130. When the amplifier 160 needs to be removed from the mask 100, depressing the spring loaded clips 165 releases the amplifier 160 from the mount 130. The amplifier mount 130 can be made of any suitable material that is light-weight and sufficiently robust for the environment into which the wearer is working. Such suitable material could include a polymer, such as a thermoset polymer, or a fiber reinforced polymer. The amplifier mount 130 can be injected molded, machined, extruded, pressed, stamped, or the like.

Beneath the amplifier mount 130 is the hose connection piece 170. The hose connection piece 170 is removably attached to the mask 100. This connection piece 170 allows for various lengths and/or types of hose to connect the mask 100 to other portions of the closed-circuit breathing apparatus. When time comes to disconnect the mask 100 from other parts of the closed-circuit breathing apparatus, depressing the breathing hose release button 175 allows the hose connection piece 170 to be removed.

As in the mask shown in FIG. 1, a wearer can attach a hose connection piece 170 to the mask 100, and in turn the mask onto his or her head. When condensation builds up behind the lens 110, the wearer can actuate the lever 140 that is part of the amplifier mount 130. The location of the lever 140 and the amplifier 160 make the configuration for the mask 100 shown in FIG. 2 simple to operate for a wearer without having an occluded view of his or her surroundings. The combination of the lever 140 with the amplifier mount 130 can not only provide a low-profile for the mask 100, but can also serve to lessen the weight of the mask by requiring less components.

Figure 3:
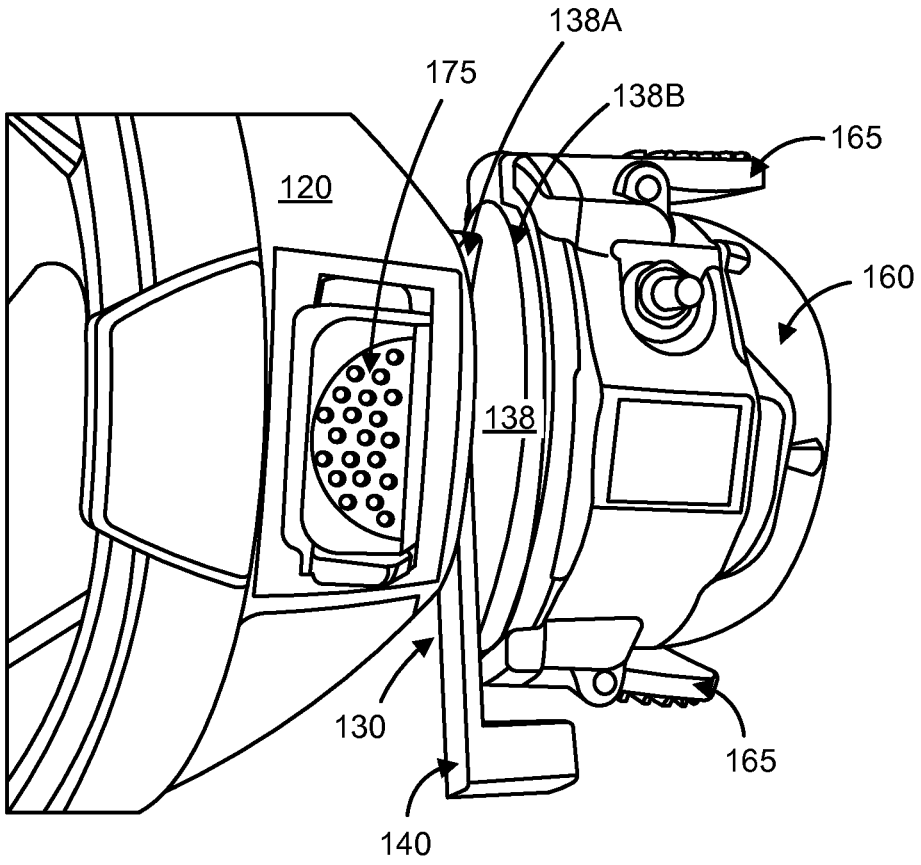
FIG. 3 shows an alternate view of a component for mounting a sound amplifier to the mask as well as a lever for actuating a lens wiper within the mask.

FIG. 3 shows an alternate view of a component 130 for mounting a sound amplifier 160 to the mask 100 of FIG. 2. The amplifier mount 130 includes the lever 140 for actuating the lens wiper (150 in FIG. 2) within the mask 100. In FIG. 3, the cowling 120 is seen with the hose release button 175 located adjacent to the amplifier mount 130. The amplifier mount 130 includes the actuating lever 140 and an amplifier mounting plate 138. The amplifier mounting plate 138 has a lower portion 138A and forward portion 138B that contacts the amplifier 160.

Because FIG. 3 allows for a view of the amplifier 160 from above, the spring loaded clips 165 that hold the amplifier 160 to the amplifier mount 130, flush against the forward portion 138B. As mentioned above, the springs within the spring loaded clips 165 bias the clips in a position that keeps the amplifier 160 affixed to the mask 100. When the amplifier 160 needs to be removed, the spring loaded clips 165 can be depressed inwards.

When condensation builds up on the inside of the mask 100, the wiper (150 in FIG. 2), can be actuated by moving the lever 140. The lower portion 138A prevents the lever 140 from moving freely and is flush with the cowling 120. The path of travel of the lever 140 corresponds to a path of travel of the wiper.

Figure 4:
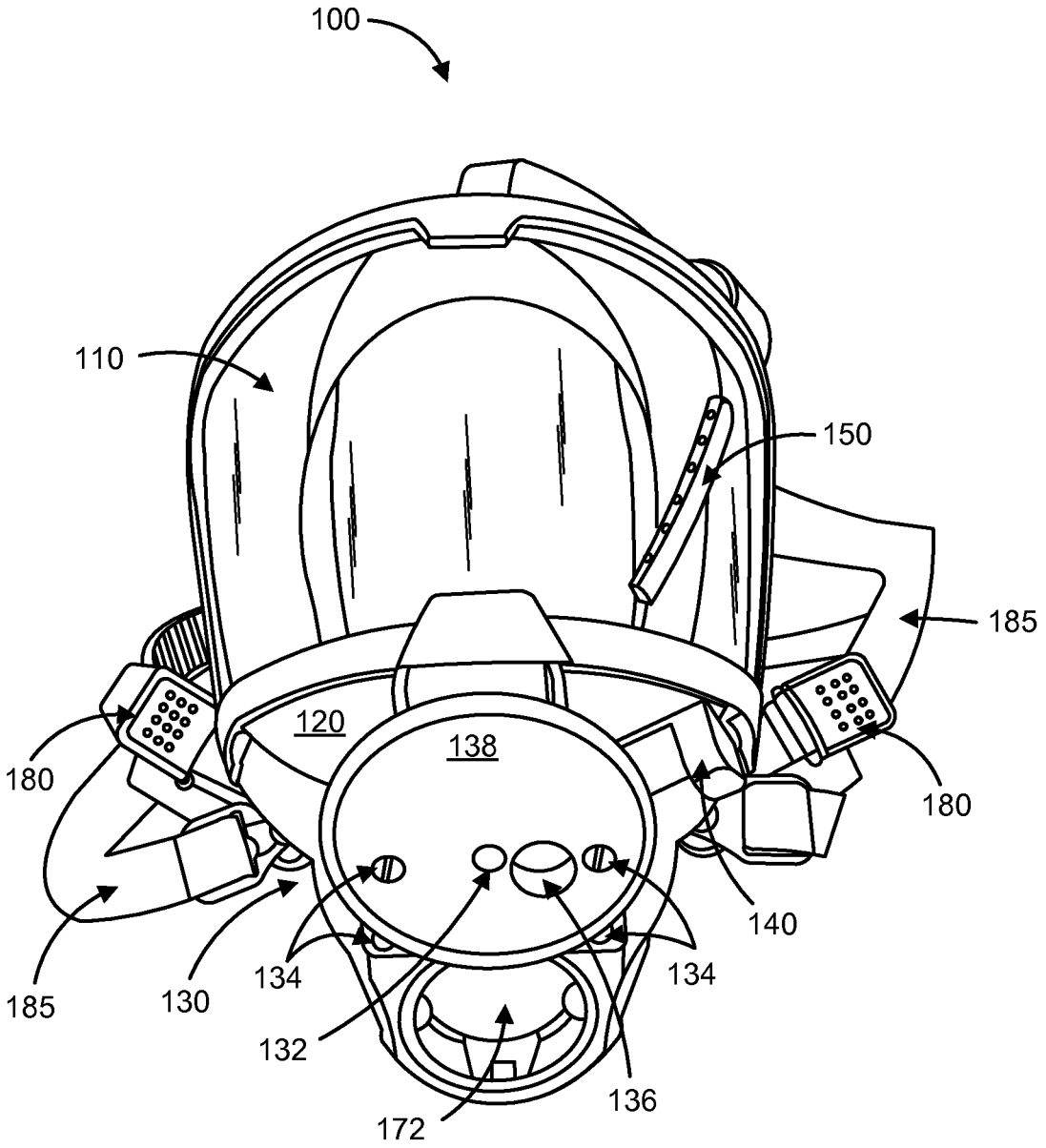
FIG. 4 is a view of a mask for a closed-circuit breathing apparatus that shows the mask without the sound amplifier attached.

FIG. 4 is a view of the mask 100 of FIGS. 2 and 3 that shows the mask 100 without the sound amplifier (160 in FIG. 3) attached. The view in FIG. 4 shows the mask 100 with its lens 110 with the wiper 150 behind it and the cowling 120 situated beneath the lens 110. Attachment straps 180 can be seen attached to the mask 100 at the top, above the lens 110, on either side, and at cowling 120. The amplifier mount 130 is located on the cowling 120, below the lens 110. The actuating lever 140 is shown at one extreme of its range of travel, and correspondingly, the wiper 150 is to one side of the interior of the lens 110. Beneath the amplifier mount 130 is an opening 172 to which the hose connection (170 in FIGS. 2 and 3) attaches.

The amplifier mount 130 is shown with the amplifier mounting plate 138 exposed. In this configuration, attaching screws 134 are seen in multiple locations on the amplifier mount 130, connecting the amplifier mount to the cowling 120. The exposed face of the amplifier mount 130 also shows a center piece 132, as well as a sound transmitting opening 136. The center piece 132 has a central opening that goes through the length of the amplifier mount 130. The central opening can be configured to be rotationally asymmetric, and the center piece 132 can be configured to connect the lever 140 to the wiper 150.

The sound transmitting opening 136 connects the interior of the mask to the amplifier (160 in FIGS. 2 and 3). The sound transmitting opening 136 can be any suitable shape to allow sound to travel towards the amplifier. The position of the sound transmitting opening 136 does not appreciably change with use of the mask 100 and is selected to overlap at least a portion of the sound transmitting diaphragm.

Figure 5A:
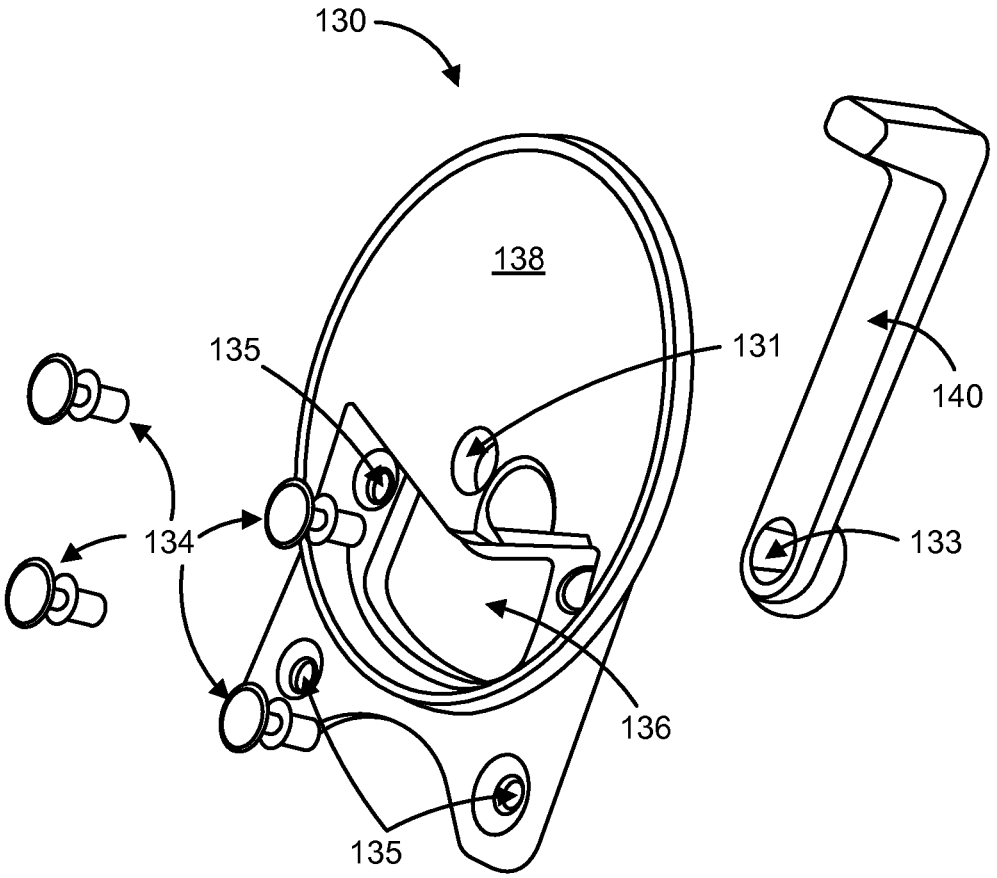
FIG. 5A is an exploded view of a component for mounting a sound amplifier to the mask as well as a lever for actuating a lens wiper within the mask.

FIG. 5A is an exploded view of the amplifier mount 130. The relative position of the amplifier mounting plate 138, the lever 140, the attaching screws 134, holes 135 for receiving the attaching screws 134, the sound transmitting opening 136, and an opening 131 in the amplifier mounting plate 138 and an opening 133 in the lever 140 through which the centerpiece 132 fits, can be seen.

Figure 5B:
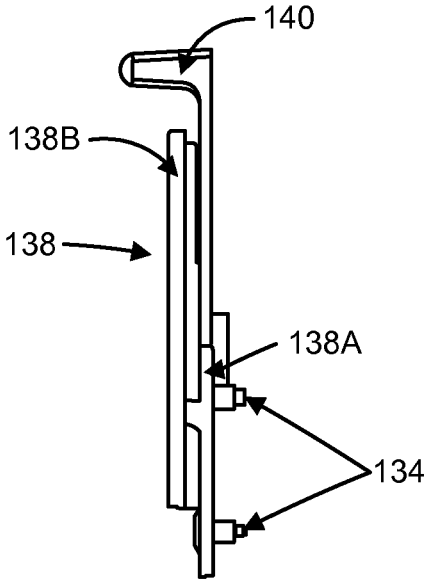
FIG. 5B is a side view of the component for mounting a sound amplifier to the mask.

FIG. 5B is a side view of the amplifier mount 130 shown in FIG. 5A. The amplifier mounting plate 138 is shown with the lever 140 connected, above the lower portion 138A. The lower portion 138A is shown with attaching screws 134 inserted, and some of the attaching screws 134 also could pass through the forward portion 138B of the mounting plate 138.

Figure 5C:
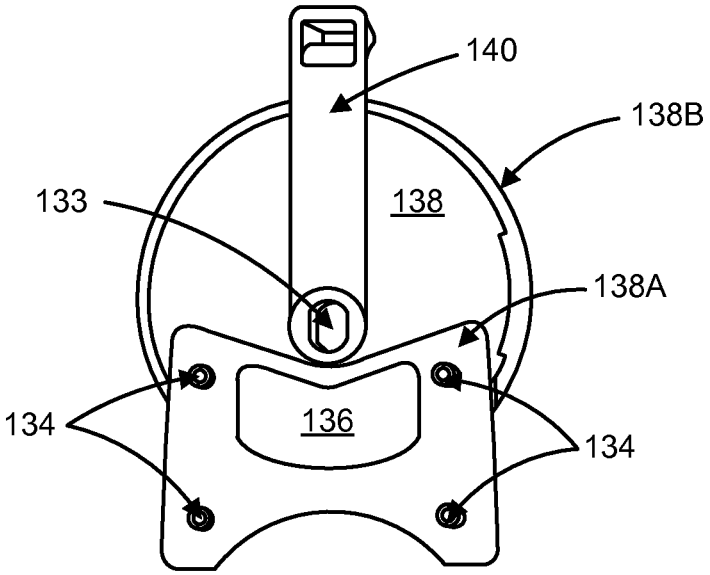
FIG. 5C is view of an assembled component for mounting a sound amplifier to the mask.

FIG. 5C is an assembled view of the amplifier mount 130 shown in FIG. 5A. This view of the mounting plate 138 is from the side of the plate that is towards the wearer of the mask. The mounting plate 138 can be seen with the lower portion 138A, the forward portion 138B, and the lever 140. At the base of the lever 140 is an opening 133 that also passes through the mounting plate 138. The sound transmitting opening 136 is seen in the lower portion 138A, and around the sound transmitting opening 136 are attaching screws 134.

Figure 6:
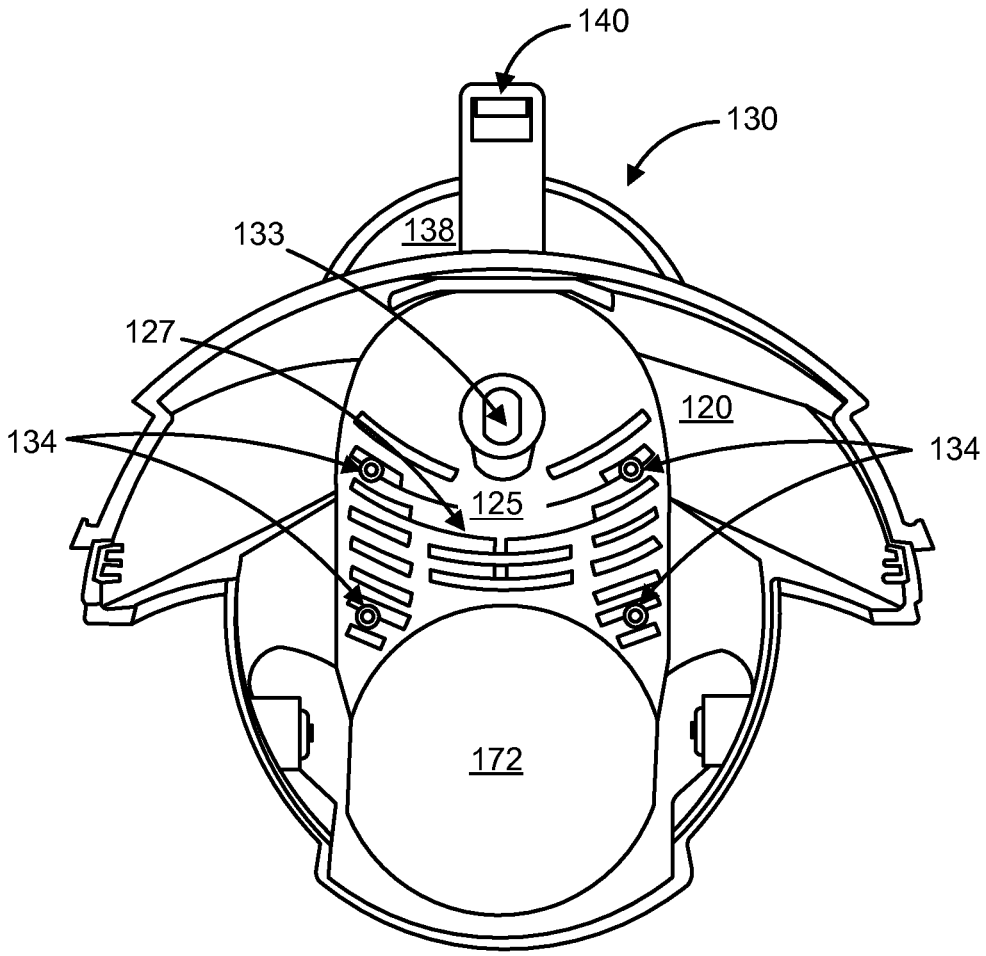
FIG. 6 is a view showing a portion of an amplifier mount attached to a portion of a mask for a closed-circuit breathing apparatus showing the portion that is nearest the wearer of the mask.

FIG. 6 is a view showing a portion of the amplifier mount 130 attached to a portion of the mask 100. The portion that is nearest the wearer of the mask 100 is shown in FIG. 6. The cowling 120 is shown from the perspective of the wearer. In the center of the cowling 120, are gratings 127 permit sound transmission. The attaching screws 134, are visible, as is the opening to which the hose connection piece attaches 172. Behind the cowling 120 is the amplifier mount 130, with the actuating lever 140 and amplifier mounting plate 138 visible. The attaching screws 134 pass through the amplifier mount 130, and the cowling 120. Similarly, the opening 133 through which the center piece 132 passes creates a passageway from the amplifier mount 130 that passes through the cowling 120, as well.

When a wearer makes a sound, such as while speaking, the diaphragm within the mask vibrates. The vibration is in turn picked up by the amplifier (160 in FIGS. 2 and 3) which makes the sound audible by other persons or devices in the vicinity of the wearer. The diaphragm can be of any suitable material, such as a thin polymer film or a thin plate of metal, ceramic, or a suitable composite. The amplifier may include a microphone, a speaker, a transmitter, a transceiver, and the like, to allow any sounds made by the wearer to be heard or transmitted. In some embodiments, the amplifier may be capable of transmitting sound made by the wearer to a receiving device that is capable of recording the sound, broadcasting the sound, or both.

Figure 7:
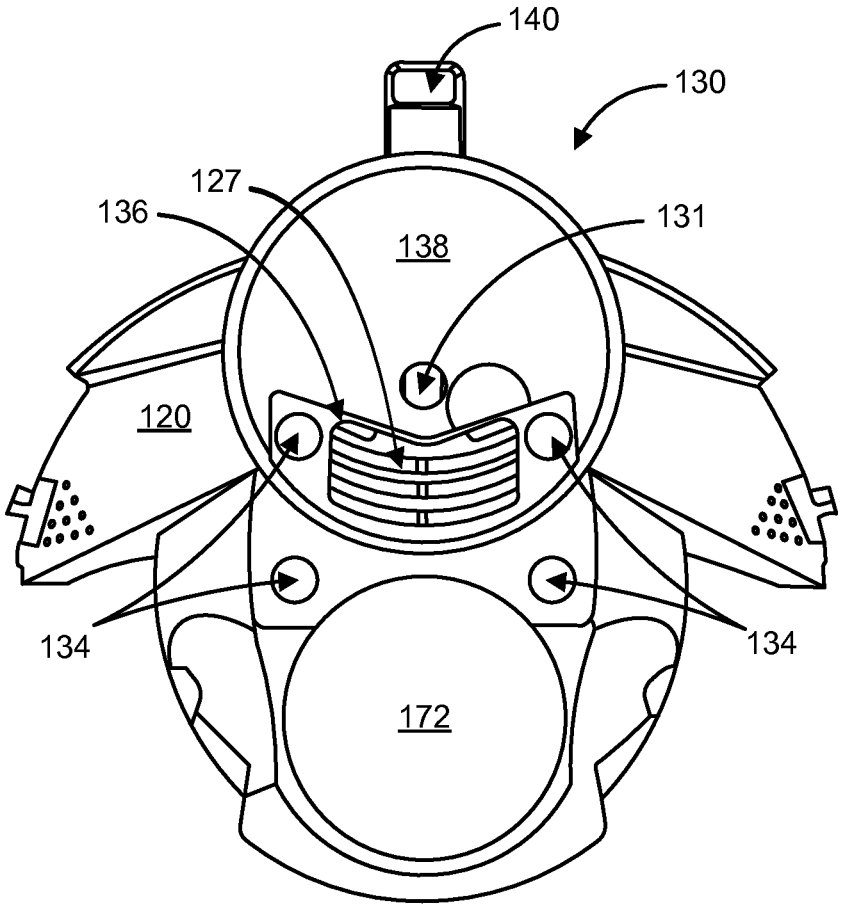
FIG. 7 is a view showing a portion of an amplifier mount attached to a portion of a mask for a closed-circuit breathing apparatus from a view opposed to the view in FIG. 6.

FIG. 7 is a view showing a portion of the amplifier mount 130 attached to a portion of a mask 100 from a view opposed to the view in FIG. 6. Closest towards the viewer is the amplifier mount 130 with its amplifier mounting plate 138, an opening 131, the lever 140 behind the amplifier mount plate, the transmitting opening 136, attaching screws 134, and the opening to which the hose connection piece attaches 172. Behind the amplifier mount 130 is the mask cowling 120. Through the transmitting opening 136, the gratings 127 from the sounding plate 125 can be seen.

The implementations set forth in the foregoing description do not represent all implementations consistent with the subject matter described herein. Instead, they are merely some examples consistent with aspects related to the described subject matter. Wherever possible, the same reference numbers will be used throughout the drawings to refer to the same or like parts.

Although a few variations have been described in detail above, other modifications or additions are possible. In particular, further features and/or variations can be provided in addition to those set forth herein. For example, the implementations described above can be directed to various combinations and sub-combinations of the disclosed features and/or combinations and sub-combinations of several further features disclosed above. In addition, the logic flows and steps for use described herein do not require the particular order shown, or sequential order, to achieve desirable results. Similarly, elements located on the front, back, side, top, or bottom of an embodiment or implementation are to be understood as relatively positioned. Other embodiments can be within the scope of the claims.

What is claimed is:

1. An apparatus, comprising:

a mounting plate with a first side configured to reversibly attach to a sound receiver; and a lever attached adjacent to a second side of the mounting plate such that it rotates and actuates a wiper located on a first side of a lens of a breathing mask, the first side of the lens configured to be closest to a wearer of the breathing mask, in front of the wearer's eyes when in use, and the wiper configured to remove condensation from the inside of the lens in an area in front of the wearer's eyes, the mounting plate comprising a sound transmitting opening in the mounting plate, the sound transmitting opening configured to allow sound made by the wearer of the mask to reach the sound receiver.

2. The apparatus of claim 1, further comprising a lower portion of the mounting plate on the second side of the mounting plate and a forward portion of the mounting plate that is configured to contact the sound receiver.

3. The apparatus of claim 2, wherein the lower portion of the mounting plate is configured to limit the travel of the lever.

4. The apparatus of claim 2, wherein the forward portion of the mounting plate is configured to allow attachment components of the sound receiver to reversibly connect to the mounting plate.

5. The apparatus of claim 4, wherein the forward portion of the mounting plate is configured to allow reversible attachment of the sound receiver to the mounting plate via spring loaded clips on the sound receiver that are biased towards a configuration that latches the sound receiver to the forward portion of the mounting plate.

6. A system, comprising:

a breathing mask, comprising:

a lens with a first side that is closer to a wearer of the mask;

a wiper positioned in contact with the first side of the lens;

a sounding plate located towards a bottom portion of the breathing mask, adjacent to the lens, configured to transmit sound from within the mask in a direction outside the mask;

a mounting plate, located in the bottom portion of the breathing mask, with a first side oriented away from the wearer and a second side oriented towards the wearer, comprising:

a sound transmitting opening, configured to overlap the sounding plate; and a lever on the second side of the mounting plate to actuate the wiper; and a sound receiver configured to attach to first side of the mounting plate;

a hose connector reversibly attached to a hose connection opening in the mask, the hose connection opening located in the bottom portion of the mask, adjacent to the mounting plate; and a hose operably connected to the hose connector and another portion of the system.

7. The system of claim 6, wherein the system comprises a closed-circuit breathing apparatus.

8. The system of claim 6, wherein the sound receiver is configured to receive sound generated by the wearer, the sounding plate and the sound transmitting opening configured to allow the sound to travel therethrough.

9. The system of claim 6, wherein the sound transmitting opening is configured to allow sound made by the wearer of the mask to reach the sound receiver.

10. The system of claim 6, further comprising a lower portion of the mounting plate on the second side of the mounting plate and a forward portion of the mounting plate that contacts the sound receiver.

11. The system of claim 10, wherein the lower portion of the mounting plate is configured to limit the travel of the lever.

12. The system of claim 10, wherein the forward portion of the mounting plate is configured to allow attachment components of the sound receiver to reversibly connect to the mounting plate.

13. The system of claim 12, wherein the attachment components of the sound receiver comprise spring loaded clips that are biased towards a configuration that latches the sound receiver to the forward portion of the mounting plate.

14. The system of claim 6, wherein the sound receiver comprises a microphone, a speaker, a transmitter, or a transceiver.

15. The system of claim 14, wherein the sound receiver is configured to transmit sound made by the wearer to a receiving device.

16. The system of claim 15, wherein the system further comprises the receiving device, wherein the receiving device comprises a sound recording component.

* * * * *